United States Patent [19]

Nejez

[11] Patent Number: 4,583,463

[45] Date of Patent: Apr. 22, 1986

[54] DERIVATION DEVICE FOR THE HAUL ROPE OF A ROPEWAY

[76] Inventor: Josef Nejez, Freytaggasse 21/13, A-1210 Wien, Austria

[21] Appl. No.: 406,674

[22] Filed: Aug. 9, 1982

[30] Foreign Application Priority Data

Aug. 21, 1981 [AT] Austria ..... 3654/81

[51] Int. Cl.[4] ..... B61B 11/02; B61B 7/10

[52] U.S. Cl. ..... 104/189; 104/182

[58] Field of Search ..... 104/115, 116, 182, 189, 104/190, 191, 192; 198/683, 686, 833

[56] References Cited

U.S. PATENT DOCUMENTS 245,626 8/1881 Grim ..... 104/191
739,984 9/1903 Case ..... 104/115
3,557,706 1/1971 Maurer ..... 104/182 X
3,797,407 3/1974 Laurent ..... 104/182

*Primary Examiner*—Robert B. Reeves
*Assistant Examiner*—Dennis C. Rodgers
*Attorney, Agent, or Firm*—Kuhn Muller and Bazerman

[57] ABSTRACT

A deviation device for laterally deviating the haul rope of a ropeway along a curvature including a revolving carrier, preferably an endless roller chain, which is guided by rails. The part of the roller chain which is situated nearer to the center of curvature follows the proposed curvature of the rope. A plurality of pivotal rope guiding levers, projecting from the roller chain, and provided with support members on their underside, supports the rope laterally in the direction towards the center of curvature and, when a rope grip engages a lever, this lever is displaced upwardly.

10 Claims, 9 Drawing Figures

13
1
15
14
16
4
13
4
7
5
10
4
11
6
8
3
3
3
2
12
10
11
2
2
17
10
6
7
11
1

DERIVATION DEVICE FOR THE HAUL ROPE OF A ROPEWAY

This invention relates to a deviation device for a haul rope which is provided with rope grips of load units of a ropeway, in particular a monocable ropeway, a chair lift, or a ski lift, wherein the rope grip portions which project from the haul rope face approximately in the direction of the center of curvature of the deviation, comprising support members for the haul rope, which are arranged in a row on a circulatory carrier, wherein the support members are arranged on pivotal levers which can be pivoted out of their normal position by the rope grip portions as they move into the deviation device.

Deviation devices of this kind are known (see DOS. No. 22 23 729), wherein a wheel which forms the deviation means for the rope carries a multiplicity of support members for the rope, which support members form a row in their normal position in the direction of movement of the rope and are each movable independently from its normal position into a position in which a gap is formed, to receive the rope grip portions which project from the rope, in the row of support members when the rope grips pass through the arrangement. The above-mentioned deviation devices suffer in particular from disadvantages in regard to dynamic motion of the arrangement, essentially because the diameter of the carrier wheel for the support members cannot be of very large size, in practical situations. Depending on the speed of travel, as the load units move into and out of the deviation device, there is a considerable jerk on the load units, and the load units leave the deviation device with a transverse swinging motion which generally has to be damped out by separate means.

The problem of the present invention is to provide a deviation device which eliminates the disadvantages of the known apparatus and which can also be used in relation to rope grip apparatus of load units which are releasable from the haul rope in operation of the arrangement.

According to the invention, this problem is solved in that the pivot axis of the pivot levers, said axis being arranged on the carrier, are disposed along the deviation section substantially parallel to the haul rope on the side of the haul rope which is remote from the center of curvature of the deviation section, wherein the pivotal levers are pivotal upwardly, and that the support members are arranged at the underside of the pivotal levers and have support surfaces for the haul rope, which are directed towards the pivot axis.

Because the construction in accordance with the invention permits the carrier for the pivotal levers to be disposed on the side of the haul rope which is remote from the center of curvature of the deviation section, the arrangement of the invention has substantial advantages over the described arrangement as disclosed in the state of the art. The deviation curve for the haul rope can be of any predetermined shape. Thus, on the one hand, the arrangement is not restricted to small radii of curvature, while on the other hand there is no necessity at all to provide constant radii of curvature. Therefore, in many cases, the rope will be curved less sharply in the actual deviation region than was necessary when using a deviation wheel, and in addition, sudden changes in direction are eliminated in the entry and exit regions, by the provision of transition curve portions.

The speed of movement can thereby be substantially increased.

Arranging the circulatory carrier on the side of the haul rope which is remote from the center of curvature of the deviation section, means that there is unlimited space available on the side of the conveyor, which is towards the center of curvature of the deviation section, so that the deviation devices according to the invention can also be used for gripping devices for carriages of monocable ropeways. The problem of guiding the rope grips to which the load units are secured, through the deviation device, can be quite simply solved with the arrangement according to the invention, in that the pivotal levers have a control surface which projects into the path of the rope grips or rope grip portions which move into the deviation device, so that the pivotal levers are pivoted upwardly thereby.

In this arrangement, the pivotal levers do not impede lateral swinging movement of the load units, which occurs to a degree that is admissible in operation of the arrangement.

The carrier for the pivotal levers is advantageously a roller chain, the rollers of which are guided in a rail-type track. It would also be possible, however, to use chains which slide in guide means or which run over stationary rollers, and individual carriages, which are coupled to each other, for each pivotal lever. The carrier for the pivotal levers may be provided with its own drive, but is is easier for the carrier to be driven by the haul rope. For that purpose, the support members are in the form of rope shoes, having grooves forming the support surfaces for the haul rope. Supporting the haul rope by means of conveyor shoes gives an advantage in regard to properly locating the conveyor cable in position and in regard to the loading on the conveyor cable, in comparison with supporting the cable by means of rollers (with a diameter which is small due to technical limitations), or pins.

The invention will now be described by way of example with reference to the drawings in which:

FIG. 1 shows a plan view of the deviation device, on to the plane in which the conveyor cable is deflected, FIG. 2 shows a view in section taken along line 2—2 in FIG. 1, FIG. 3 shows a view in section taken along line 3—3 in FIG. 1, and FIG. 4 shows a view in section taken along line 4—4 in FIG. 1.

These sectional views show the mode of operation of the pivotal levers.

Figure 1:
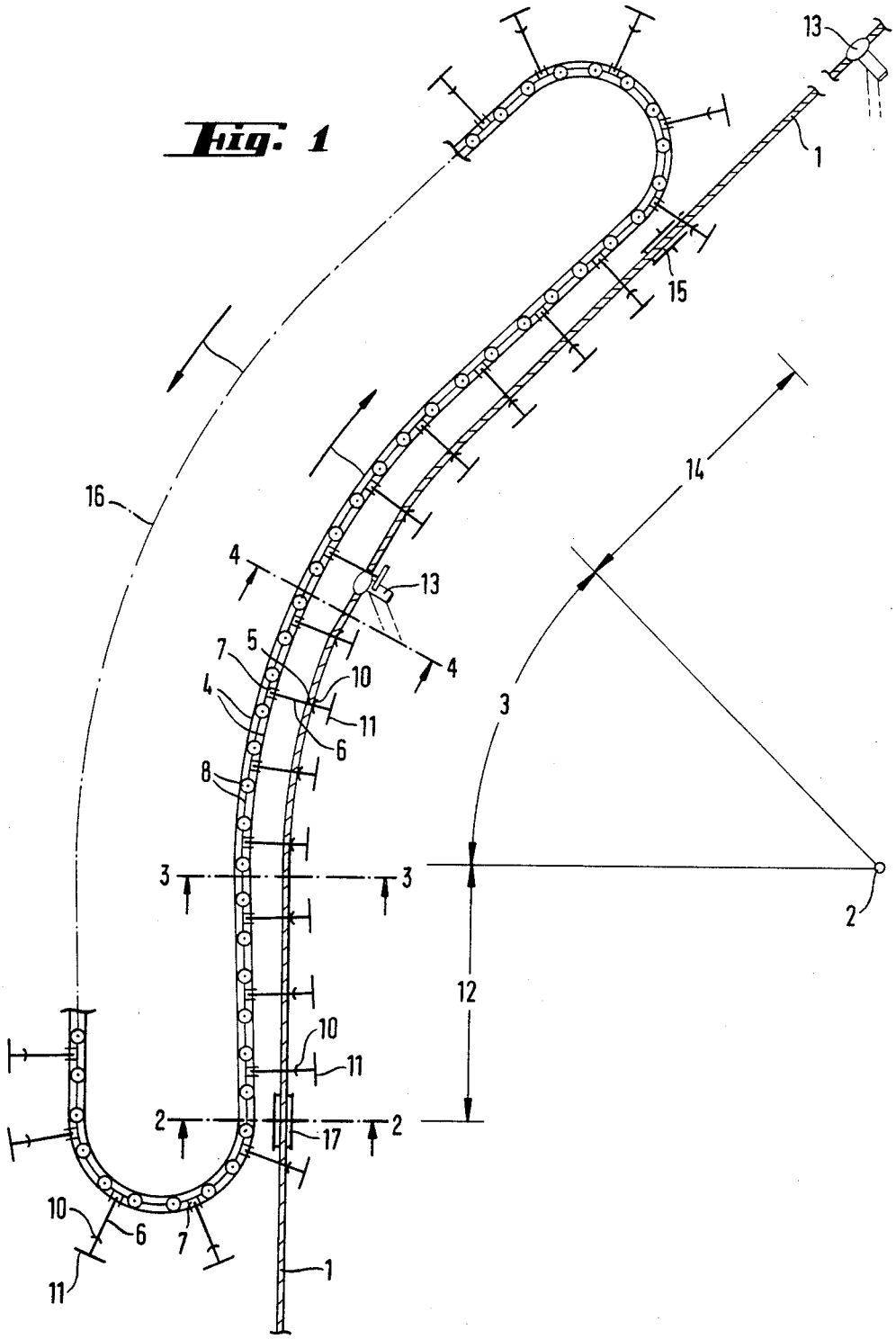
Figure 2:
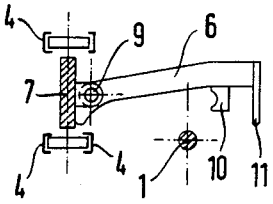
Figure 3:
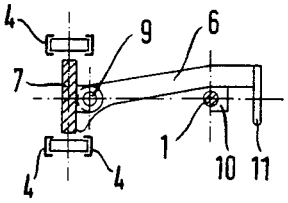
Figure 4:
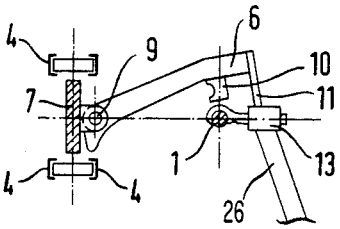

On the haul rope 1 of ropeway, in particular a mono cable ropeway, a chair lift or suface lift, in usual manner spaced load carriers 26 are connected having, each, a rope grip 13 by which they are secured to the rope 1. The haul rope is laterally deviated by pivotal rope guiding levers 6 along a track or path 4 which is arranged on the side of the haul rope which is remote from the centre of curvature 2 of the deviation section 3. The rope support points 5 are formed by support members 10 for absorbing the deviation force, which are arranged on the pivotal levers 6. The pivotal levers 6 are mounted on members 7 of a revolving carrier in the form of a roller chain or the like as indicated at 8, in such a way that the pivotal levers 6 can be pivoted upwardly about an axis of rotation 9 which is parallel to the haul rope 1. The pivotal levers 6 have on their underside a support member 10 in the form of a cable shoe for receiving the haul rope 1 and a control surface 11 for bearing against rope grips which project from the haul rope. Due to the position of the track 4 relative to the haul rope 1, in the entry region 12, the pivotal levers are moved towards the haul rope 1 in such a way (see FIG. 2) that the haul rope 1 is laid into the cable shoe 10 of the pivotal lever 6 (see FIG. 3) or that, upon entry of a rope grip 13, rope grips forming a control surface cause a pivotal lever to be pointed upwardly, and the cable shoe thereof remains out of engagement (see FIG. 4). In the exit region 14, the pivotal levers 6 are moved away from the haul rope 1 in such a way that the cable shoe 10 of the pivotal levers 6 is moved off the haul rope 1 or that a pivotal lever which has been moved into a deflected position is returned to its normal position. From the end of the exit region 14, which is formed by a haul rope roller 15, the pivotal levers 6 are guided back along an outer track or path 16 for the circulating roller chain or the like as indicated at 8, to the beginning of the entry region 12, which is formed by a haul rope roller 17.

Figure 5:
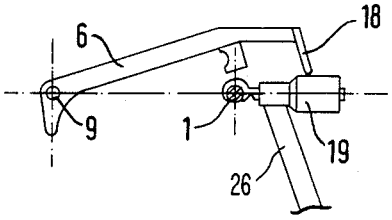
FIGS. 5 to 8 show other embodiments of the pivotal rope guiding levers including different gripping devices in views analogous to FIG. 4.

FIG. 5 shows an embodiment of the pivotal levers in relation to rope grips having a spring storage means, with the track or path and the roller chain or the like being omitted.

The control surface 18 is so arranged and formed on the pivotal levers 6 that, in the case of rope grips for load units which cannot be released from the haul rope in operation of the arrangement, the housing 19 of the spring storage means forms the control surface for upward pivotal movement of the pivotal lever.

Figure 6:
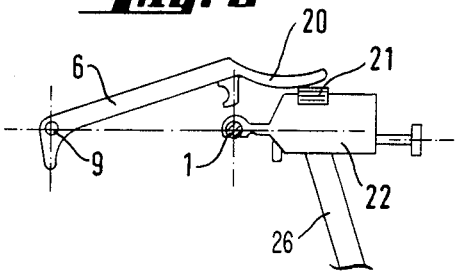

FIG. 6 shows an embodiment of the pivotal levers, in relation to gripping devices with motion plate members, with the track or path and the roller chain or the like being omitted.

The control surface 20 is so arranged and formed on the pivotal levers 6 that, in the case of gripping devices for a load unit which cannot be released from the haul rope in operation of the arrangement, the motion plate member 21 of the gripping device 22 forms the control surface for upward pivotal movement of the pivotal lever.

Figure 7:
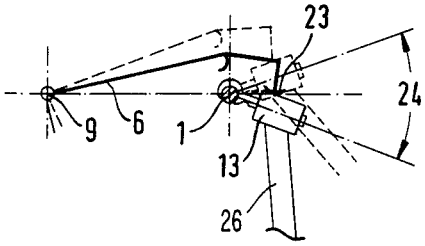

FIG. 7 is a diagrammatic view of an embodiment of the traction elements which permit the pivotal lever to be satisfactorily pivoted upwardly, even in the case of a load unit which is swinging transversely to a degree which is permissible in operation of the arrangement. The track or path and the roller chain or the like are not shown in FIG. 7.

The control surface 23 on the pivotal levers 6 is so arranged and formed that satisfactory upwardly pivotal movement of the pivotal lever is ensured by the gripping devices, which form a control surface and which project from the haul rope, of rope grips 13 of a load unit which swings transversely to a degree that is admissible in operation of the arrangement, as indicated at 24.

Figure 8:
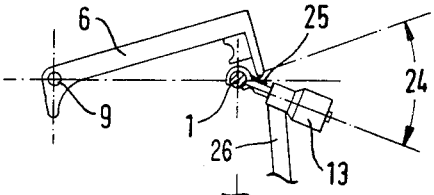

FIG. 8 shows an embodiment of the control surface on rope grips or gripping devices which also permits satisfactory upward pivotal movement of the pivotal lever, in relationship to a load unit which swings transversely to an extent that is admissible in operation of the arrangement. FIG. 8 does not show the track or path and the roller chain or the like. FIG. 8 only shows the downwardly deflected position of the rope grip or the gripping device.

Figure 9:
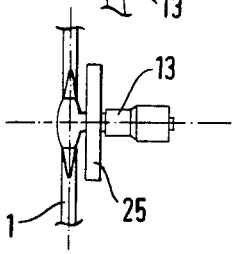
FIG. 9 is a partial top view of the device of FIG. 8.

FIG. 9 shows a plan view of the rope grip or gripping device shown in FIG. 8, but without showing the pivotal lever.

The control surface 25 on the rope grips 13 of load units which are not releasable from the haul rope in operation of the arrangement, or on the gripping device of load units which can be released from the haul rope in operation of the arrangement, is of such an arrangement and form that satisfactory upward pivotal movement of the pivotal lever is ensured, even in regard to load units which swing transversely to an extent that is admissible in operation, as indicated at 24.

I claim:

1. A deviation device for the haul rope of a ropeway, in particular a monocable ropeway including spaced load carriers having, each, a rope grip by which they are secured to said rope; a revolving carrier of rope guiding means for laterally deviating said haul rope into a curved path about a given center of curvature, said revolving carrier being on the side of said haul rope remote from the said center of curvature and having a curved part which follows the proposed curvature of said rope and which is situated on that side of the carrier which is adjacent the said haul rope; said rope guiding means comprising a plurality of pivotal levers mounted with their axis on said revolving carrier in a row in the revolving direction, said pivotal levers projecting from said revolving carrier and being pivotable from a normal (first) position to a lifted (second) position, the pivot axis of said levers extending in the revolving direction of said carrier, support members being arranged on the underside of said levers comprising support faces for the haul rope, said support faces being directed toward the pivot axis of said levers, so that, when the haul rope enters said curved part of the revolving carrier of rope guiding means which is in the direction of the center of curvature, the haul rope is laterally towards the center of curvature supported by said pivotal levers in normal position, and, when a rope grip engages a pivotal lever, said lever is displaced upwardly in lifted position.

2. A device according to claim 1 characterised in that the carrier for the pivotal levers is a roller chain arranged on the side of the haul rope remote from the centre of curvature of the deflection section, wherein the rollers of the roller chain are guided at least in the region of the deflection section of the haul rope in a rail-like track which is curved in accordance with the deflection of the haul rope.

3. A device according to claim 2, characterized in that, the spacing between the haul rope and the roller chain is less than or equal to the spacing of the support member from the roller chain at the beginning and end of the region where said haul rope and roller chain are adjacent.

4. A device according to claim 3 characterized in that at least one cable roller is arranged at the beginning of the said region where said haul rope and roller chain are adjacent and/or at the end of the said region, said at least one cable roller being closer to the roller chain than the support members of the pivotal levers at that point.

5. A device according to claim 1 characterized in that the pivotal levers have a control surface which projects into the path of the said rope grips as said grips move into the said device so that the pivotal levers are pivoted upwardly thereby.

6. A device according to claim 5 characterized in that the control surface is formed on a projection which projects downwardly from the pivotal lever.

7. A device according to claim 5 characterised in that the control surface is formed on the pivotal lever on the side of the support member which is remote from the lever pivot axis.

8. A device according to any one of claims 1 or 2 or 3 or 4 or 5 or 6 or 7 characterized by a circulatory carrier for the pivotal levers, which is pulled by the haul rope.

9. A device according to claim 7, characterized in that the control surface is formed on a projection which projects downwardly from the pivotal lever.

10. A device according to claim 1 characterized in that the support members are in the form of cable shoes provided with grooves forming the support surfaces.

* * * * *